US005857371A

United States Patent [19]

Bindernagel et al.

[11] Patent Number: 5,857,371

[45] Date of Patent: Jan. 12, 1999

[54] ROLL BLOCK FOR ROLLING WIRE, RODS, PIPES, OR FLAT METAL MATERIAL TO BE ROLLED

[75] Inventors: Ali Bindernagel, Wermelskirchen; Harry Weingartner, Oberhausen, both of Germany

[73] Assignee: Kocks Technik GmbH & Co., Hilden, Germany

[21] Appl. No.: 853,925

[22] Filed: May 9, 1997

[30] Foreign Application Priority Data

May 11, 1996 [EP] European Pat. Off. ..... 196 19 134.3

[51] Int. Cl.[6] ..... B21B 13/08

[52] U.S. Cl. ..... 72/234; 72/224

[58] Field of Search ..... 72/224, 225, 227, 72/234, 237, 249

[56] References Cited

U.S. PATENT DOCUMENTS

| | | | |
|---|---|---|---|
| 1,782,968 | 11/1930 | Keller | 72/224 |
| 2,214,279 | 9/1940 | Kocks | 72/224 |
| 3,181,332 | 5/1965 | Vom Dorp et al. | 72/224 |
| 3,595,055 | 7/1971 | Rohde | 72/226 |
| 4,408,476 | 10/1983 | Brauer et al. | 72/234 |
| 4,559,799 | 12/1985 | Funke et al. | 72/224 |
| 5,566,564 | 10/1996 | Brauer | 72/224 |

FOREIGN PATENT DOCUMENTS 23 36 417 2/1975 Germany .

*Primary Examiner*—Joseph J. Hail, III
*Assistant Examiner*—Rodney Butler
*Attorney, Agent, or Firm*—Michael J. Striker

[57] ABSTRACT

A roll block for rolling wire, rods, pipes and flat metal material to be rolled, has a plurality of exchangeable roll stands located closely next to one another in a roll line and each having a plurality of rollers, a plurality of C-shaped frames holding the roll stands and positioned closely next to one another, turning moments transfer components provided in the C-shaped frames for driving the rollers, a number of the C-shaped frames corresponding to a maximum number of the roll stands, a common stand housing located at a drive side of the C-shaped frames and spaced therefrom, intermediate transmissions located at a front side of the common stand housing facing the C-shaped frames in a separately changeable manner, driving motors located at a rear side of the common stand housing remote from the C-shaped frames and coupled to the intermediate transmissions in a separately exchangeable manner, the intermediate transmissions and the C-shaped frames having mutually coupled shafts which bridge a spacing between the stand housing and the C-shaped frames.

12 Claims, 4 Drawing Sheets

ROLL BLOCK FOR ROLLING WIRE, RODS, PIPES, OR FLAT METAL MATERIAL TO BE ROLLED

BACKGROUND OF THE INVENTION

The present invention relates to a roll block for rolling wire, rods, pipes or flat metal material to be rolled, having a number of exchangeable roll stands disposed closely next to one another in a roll line and each having a plurality of rollers and a plurality of C-shaped frames which hold the roll stands and are positioned closely next to one another with turning moment transfer components for driving each roller.

A known roll block of this type is disclosed in DE-OS 23 36 417. It has two roll stands each held by a C-shaped frame. The distributor and diverting transmissions, as turning moment transfer components for the two roll stands of each C-shaped frame, are combined to form one unit. Therefore in the known construction type it is not possible to produce a roll block with any desired number of roll stands but only one with a even number thereof. If, by reason of the provided rolling programme and the materials to be rolled, the arrangement of the roll block produces an uneven maximum number of roll stands, an additional roll stand, which is in fact superfluous, must be provided in the case of this construction type. This leads to considerable extra expense and clearly higher costs since not only the additional roll stand, but an additional driving part also have to be provided. This construction type is bound to a particular formation which is fixed once and for all. It is, for example, only possible with uneconomically high expense to increase the maximum number of roll stands at a later date. The intermediate transmission driving the distributor transmission of the C-shaped frames are usually formed in a specific manner for this roll block and also disposed in a specific way together with their driving motors. Special transmissions of this type are usually expensive, being manufactured individually, and this also applies for their replacement parts. In the case of a fault the roll block and often the whole installation is shut down for a long time until the special replacement parts are acquired and the repair completed.

SUMMARY OF THE INVENTION

It is therefore an object of the present invention to provide a roll block of the above mentioned general type, which eliminates the aforementioned disadvantages and is constructed according to the modular principle using exchangeable individual modules.

According to the present invention, the roll block has a number of C-shaped frames corresponding to its maximum number of roll stands, on the drive side of which frames is located a common stand housing at a spaced distance therefrom, on the front side of which facing the C-shaped frames, intermediate transmissions are attached in a separately exchangeable manner, and on the rear side of which, remote from the C-shaped frames, driving motors coupled to the intermediate transmissions are attached, in a separately exchangeable manner, wherein the spacing between the stand housing and the C-shaped frames is bridged by mutually coupled shafts of the intermediate transmissions and of the C-shaped frames.

In accordance with a preferable embodiment of the invention, each roll stand has an individual C-shaped frame so that the roll block can be provided with any desired number of roll stands and thus be adapted precisely to individual requirements. Uneconomical additional expense is avoided. Each C-shaped frame is extensively independent of the neighboring C-shaped frames and thus in particular cases one or more such C-shaped frames, and therewith their roll stands, can be removed from the roll block or can be inserted. The roll block can still thus be adapted even at a later date to a changed requirement, for example, to a different number of roll stands. If at individual stand sites other roll stands, for example, ones with different roll diameters, are later desired this can be achieved by exchanging the roll stands and the C-shaped frames. Since the intermediate transmissions are disposed on the front side of the stand housing and not therein, they can also be moved at a later date with little expense and so adapted to a possible different C-shaped frame. In the same way, this is also true for the driving motors on the rear side of the stand housing. It is particularly preferred that so-called standard transmissions or transmissions which can be ordered from a catalogue, which as a rule are clearly more economical than special transmissions, be used as the intermediate transmissions. In particular, in the case of the single drive for each C-shaped frame or roll stand the aforementioned different roll advantages apply.

In accordance with a further advantageous embodiment of the invention the C-shaped frames, with the exception of their turning moment transfer components, are formed symmetrically around an axis of symmetry extending horizontally through the longitudinal central axis of the material to be rolled. Consequently, as a rule, only one type of C-shaped frame needs to be produced and this is inserted into the roll block only in an alternating series, with shafts disposed at the top or bottom and coupled to the intermediate transmissions, in order to achieve the required offset arrangement of the rollers.

The C-shaped frames can expediently stand on a common base frame and under a common cover frame. By means fo these latter-named frames, all the C-shaped frames of the roll block are connected to each other, but preferably in a releasable manner, to form a unit.

It is useful if the C-shaped frames of the roll block are formed identically to each other. This simplifies manufacture. On the other hand, however, it is also possible for some of the C-shaped frames of the roll block to be formed differently, in particular in order to be able to receive roll stands of different dimensions to the usual ones.

In a further embodiment of the invention, the roll stands within the C-shaped frames stand on a common lower frame receiving part and under a common upper throughgoing frame receiving part which, in the region of the end faces of the roll block, are connected to each other by cross pieces at the inlet and outlet sides to form an inner frame. This inner frame holds the roll stands in their provided position and principally relices the C-shaped frames of the longitudinal forces. It is thus recommended for the roll stands to be able to be clamped firmly together inside the inner frame in the longitudinal direction of the material to be rolled, by means of a clamping cylinder.

In some cases it is advantageous if the roll block which is ready for operation is fitted with roll stands with different roller diameters and/or a different number of rollers. The shape and dimensions of the incoming material and of the outgoing rolled material are an indication of which assembly is chosen. The requirements with respect to calibration can in any case be fulfilled with the roll block in accordance with the invention because of its modular construction. Therefore it is also expedient to allocate to each of the C-shaped frames a separate intermediate transmission together with the driving motor. An adaption of the rotational speeds is then no longer a problem. In contrast, it can also be useful if, in the manner of a group drive, a common intermediate transmission together with the driving motor is allocated to a plurality of the C-shaped frames.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
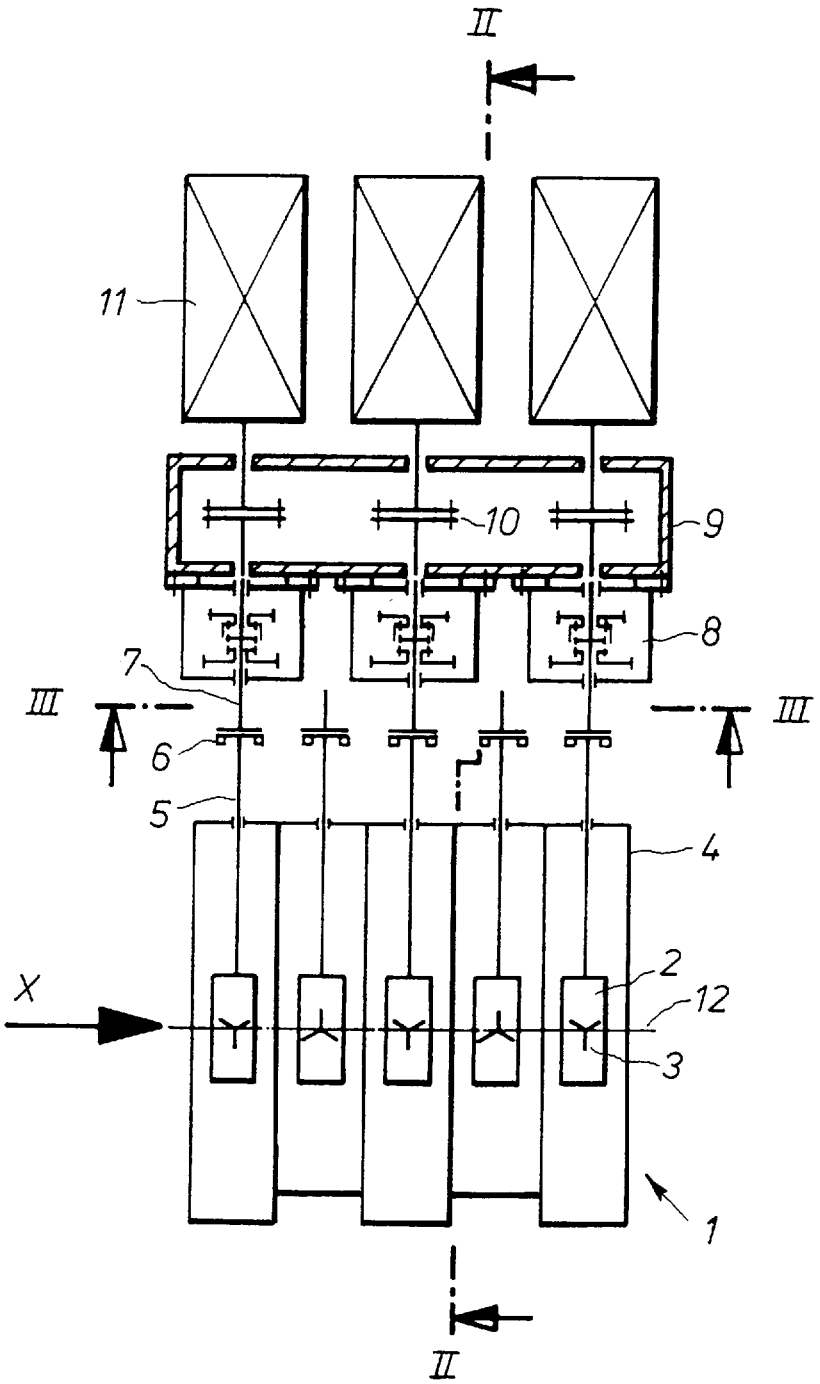
FIG. 1 schematically illustrates a roll block in accordance with the invention, in a plan view, partially in cross-section.

FIG. 1 illustrates a roll block 1 with a total of five roll stands 2. There can, however, be any number of roll stands 2. In this example, each of the roll stands 2 has three rollers disposed in a star shape which are not visible in FIG. 1 but are only indicated by the symbols 3 of which the offset arrangement can be seen. Each roll stand 2 is located in an individual disc-like, C-shaped frame 4 which is illustrated only schematically as a box in FIG. 1. The roll stands 2 or rather their rollers are driven by driving shafts 5 which are coupled by means of couplings 6 to the driving shafts 7 of the intermediate transmissions 8.

The intermediate transmissions 8 are located on the outside on a stand housing 9 illustrated in horizontal cross-section and disposed spaced from the C-shaped frames 4, in which stand housing only couplings 10 are disposed which couple the intermediate transmissions 8 to driving motors 11. In the illustrated exemplified embodiment each roll stand 2 is provided with an individual driving motor 11. Two of the driving motors 11 are located above the plane of cut indicated in FIG. 2 and are therefore not shown in FIG. 1. An arrow X shows the rolling direction and a broken line 12 shows the longitudinal central axis of the material being rolled.

Figure 2:
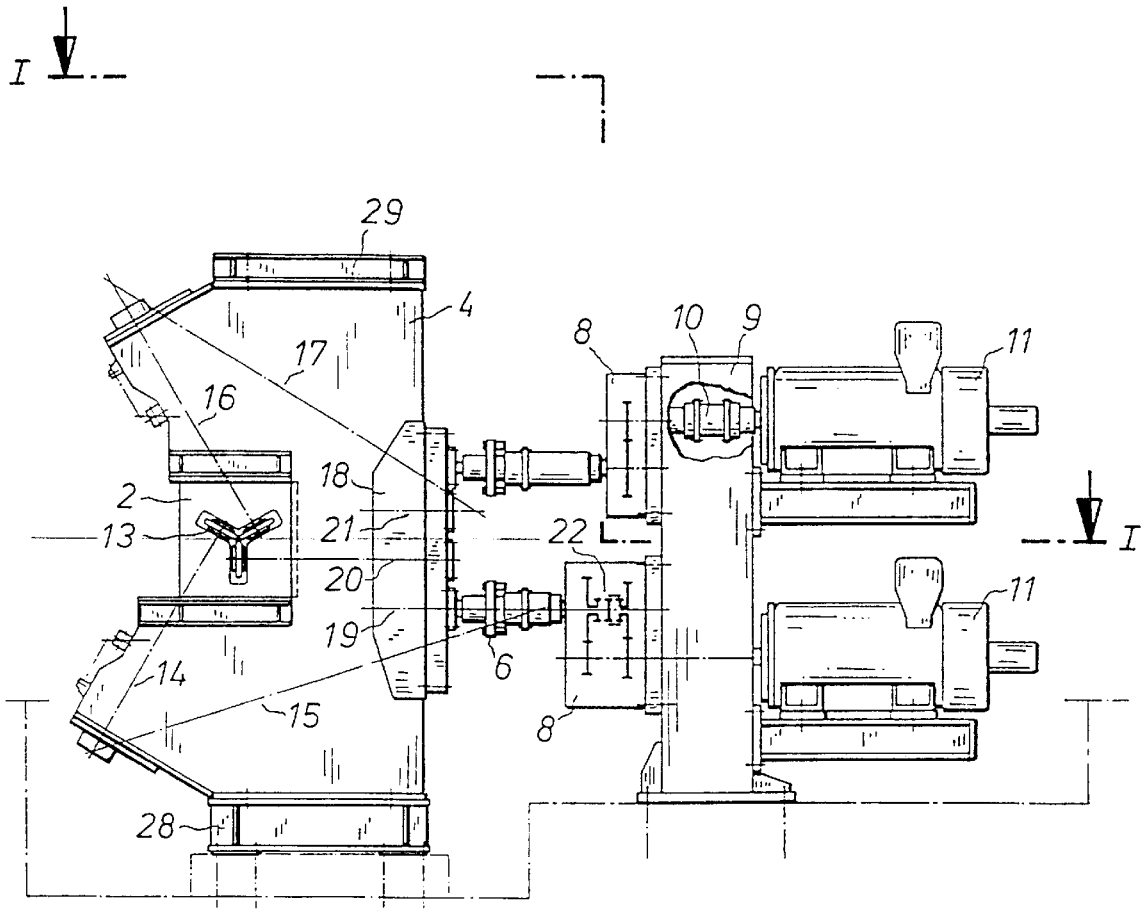
FIG. 2 illustrates a cross-sectional view along the line II—II of FIG. 1.

FIG. 2 shows the C-shaped formation of the frames 4 in which the roll stands 2 with their rollers 13 are disposed. Broken lines 14, 15, 16 and 17 indicate the axes of the turning moment transfer shafts for driving the rollers 13, which transfer the turning moment from one distributor transmission 18 to the rollers 13. The distributor transmission 18 has three shafts 19, 20 and 21 which are disposed one above the other. The lowermost shaft 19 of the distributor transmission 18 and therefore of the C-shaped frame 4 form, as it extends, the driving shaft 5 (FIG. 1) and is coupled by the coupling 6 to the driving shaft 7 of the intermediate transmission 8 which, for example, can also have a switching transmission step 22. The driving motor 11 disposed at the top in FIG. 2 belongts ot the neighboring C-shaped frame 4 lying behind the plane of cut of FIG. 2 and which is disposed in reverse so that its shaft 19 is located at the top. Consequently the associated intermediate transmission 8 and its drive motor 11 are also disposed at the top.

Figure 3:
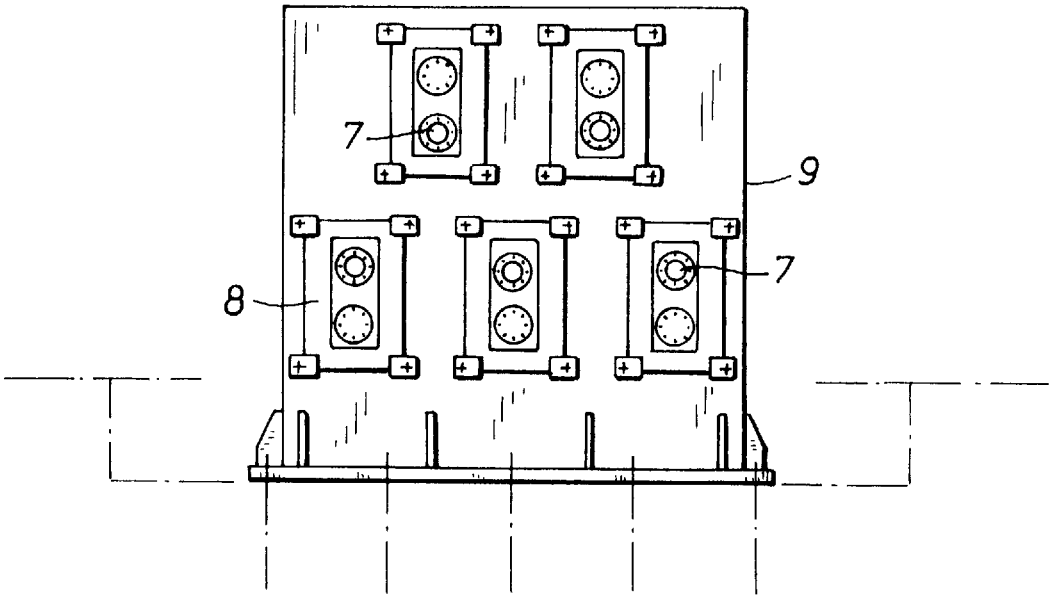
FIG. 3 illustrates a cross-sectional view along the line III—III of FIG. 1.

FIG. 3 shows the afore-mentioned alternating arrangement of the intermediate transmissions 8 and how they are disposed on the front side of the stand housing 9.

Figure 4:
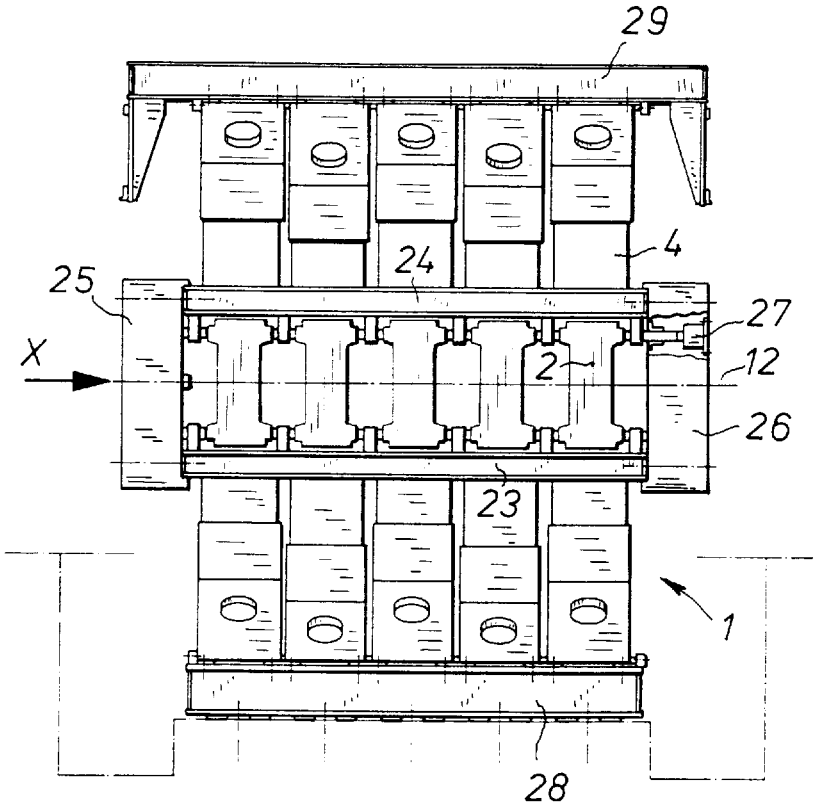
FIG. 4 illustrates a front view of the roll block.

FIG. 4 principally shows that the roll stands 2 stand on a throughgoing lower frame receiving part 23 common to them and stand under an upper frame receiving part 24 of this type. In the region of the end faces of the roll block 1, the two frame receiving parts 23 and 24 are connected to each other to form a closed inner frame by a respective cross piece 25 and 26. During operation, clamping cylinders 27 clamp the roll stands 2 in the axial direction to form a fixed block. The disc-like C-shaped frames 4 are connected to each other and in particular in that they stand on a base frame 28 which is common to them and under a common cover frame 29, to which frames they are screwed in a releasable manner.

It will be understood that each of the elements described above, or two or more together, may also find a useful application in other types of constructions differing from the types described above.

While the invention has been illustrated and described as embodied in roll block for rolling wire, rods, pipes, or flat metal material to be rolled, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A roll block for rolling wire, rods, pipes and flat metal material to be rolled, the roll block comprising a plurality of exchangeable roll stands located closely next to one another in a roll line and each having a plurality of rollers; a plurality of C-shaped frames holding said stands and positioned closely next to one another; turning moments transfer components provided in said C-shaped frames for driving said rollers, a number of said C-shaped frames corresponding to a maximum number of said roll stands; a common stand housing provided for all said roller stands, said common stand housing being located at a drive side of said C-shaped frames and spaced therefrom; intermediate transmissions located outside of and at a front side of said common stand housing facing said C-shaped frames in a separately changeable manner; driving motors located at a rear side of said common stand housing remote from said C-shaped frames and coupled to said intermediate transmissions in a separately exchangeable manner, said common stand housing supporting said driving motors and said intermediate transmissions at the respective sides, said intermediate transmissions and said C-shaped frames having mutually coupled shafts which bridge a spacing between said stand housing and said C-shaped frames.

2. A roll block as defined in claim 1, wherein said roll stands are formed to define a longitudinal central axis of a material to be rolled, said C-shaped frames, with the exception of said turning moment transfer components, being formed symmetrically relative to an axis of symmetry extending horizontally through said longitudinal central axis of the material to be rolled.

3. A roll block as defined in claim 1; and further comprising a common base frame; and a common cover frame, said C-shaped frames standing on said common base frame and under said common cover frame.

4. A roll block as defined in claim 1, wherein said C-shaped frames are formed identically to each other.

5. A roll block as defined in claim 1; and further comprising a common lower throughgoing frame receiving part and a common upper throughgoing frame receiving part located inside said C-shaped frames, said roll stands within said C-shaped frames standing during an operation on said common lower throughgoing frame receiving part and below said common upper throughgoing frame receiving part.

6. A roll block as defined in claim 1, wherein said roll stands have different roller diameters.

7. A roll block as defined in claim 1, wherein said roll stands have a different number of rollers.

8. A roll block as defined in claim 1, wherein said roll stands have different roller diameters and a different number of rollers.

9. A roll block as defined in claim 1, wherein each of said C-shaped frames in provided with a separate one of said intermediate transmissions together with said driving rotor.

10. A roll block as defined in claim 1; and further comprising a common intermediate transmission which together with said driving motor is provided for a plurality of said C-shaped frames in a manner of a group drive.

11. A roll block defined in claim 5; and further comprising cross pieces which at end faces of the roll block connected said common lower throughgoing frame receiving part and said common upper throughgoing frame receiving part to each other at inlet and outlet sides of the roll block as considered in a direction of movement of the material to be rolled, to from an inner frame.

12. A roll block as defined in claim 11; and further comprising a clamping cylinder which firmly clamps said roll stands together inside said inner frame in a longitudinal direction of the material to be rolled.

* * * * *